US005680957A

United States Patent [19]

Liu

[11] Patent Number: 5,680,957

[45] Date of Patent: Oct. 28, 1997

[54] DRAWER TYPE STORAGE BIN

[76] Inventor: Cheng-Chia Liu, No. 10, Sung-Chiang N. Rd., Chung-Li City, Taiwan

[21] Appl. No.: 756,553

[22] Filed: Nov. 26, 1996

[51] Int. Cl.[6] ..... B65D 27/04

[52] U.S. Cl. ..... 220/663; 220/602; 312/348.4

[58] Field of Search ..... 220/663, 662, 220/664, 665, 602; 312/330.1, 334.8, 348.4

[56] References Cited

U.S. PATENT DOCUMENTS

| | | | |
|---|---|---|---|
| 498,299 | 5/1893 | Petway et al. | 220/663 |
| 3,672,749 | 6/1972 | Roser | 220/663 |
| 4,192,439 | 3/1980 | Segal | 220/662 |
| 4,501,359 | 2/1985 | Yoshizawa | 220/662 |
| 4,805,680 | 2/1989 | Veno | 220/663 |

*Primary Examiner*—Joseph M. Moy
*Attorney, Agent, or Firm*—Bacon & Thomas

[57] ABSTRACT

Drawer type storage bins suitable for stacking one on another and each includes an inner case and an outer housing, the case is placed in the housing, a handle is exposed out of an opening on the front side of the housing and can be drawn out of it, above the handle, a slightly outwardly bending semi-transparent curved surface is provided for magnifying images of the goods stored in the case; a set of protruding buckles are provided on the top edge of the rear side of the housing to be interengaged with a locking strip, thus the storage bins can be locked to get firmer stacking of them, the locking strip can be formed in passing during injection molding of the housing and is attached thereon, effect of the product is improved without increasing of cost of production, yet a novel style of the drawer type storage bins can be obtained.

1 Claim, 2 Drawing Sheets

DRAWER TYPE STORAGE BIN

BACKGROUND OF THE INVENTION

1. Field of the Invention

The present invention relates to drawer type storage bins which are especially suitable for stacking one on another, on the front face and above a handle of each bin, a slightly outwardly bending semi-transparent curved surface is porvided for magnifying images of the goods stored therein, a set of protruding buckles are provided on the top and the rear side of each housing thereof to fix the stacked bins, an object of convenient use can thus be achieved.

2. Description of the Prior Art

Design of storage bins is for substitution for the shelves, wardrobes etc. to store clothes, tools, or samples, files etc. for companies or factories. Characteristic of the storage bins is that each of them can be individully used, articles can be placed in the next storage bin when the first one is full of goods therein, all the storage bins can be stacked one on another or placed in lines depending on the space capability, in this way, space for storage can be saved. Storage bins sold in the markets are all plastic, they are light, durable and costed low, they can take the places of the heavy and expensive ward robes and shelves, so they are quite welcome by the units such as families, companies and factories.

Storage bins further are divided into cover type and drawer type storage bins, so that users can use them in stacked state or in lines depending on the actual space situations of the users. A drawer type storage bin includes an inner case and an outer housing which is basically a rectangular housing having an opening on the front side thereof, when the storage bins are stacked with one another, every opening is faced forwardly; the inner case is received in the outer housing and is provided with a handle on the front surface thereof, the upper surface thereof is opened, when the handle is drawn out, the empty inner case is for storing goods, like a drawer. However, although the drawer type storage bin of the above stated structure can be used, a lot of problems need to be solved. Firstly, the front surface of the inner case is made of semi-transparent plastic material for inspecting of the goods placed in the inner case, it is necessary to explain that, structurally, the inner case and the outer housing are all integrately formed of plastic, they are slightly elastic, the so called "semi-transparent" is limited to certain degrees of transparency because of the material they are made of, they are not completely transparent as glass is, the received goods at the most inner portion can not be seen so clearly. Besides this defect, a quite important matter is the stability of the bins stacked with one another, although they are connected somewhat firm by the grooves and the protruding ribs provided at the upper and lower areas respectively on the outer housings of them, the bins stacked to the higher positions will be separated and fall, stability of them is therefore not adequate.

SUMMARY OF THE INVENTION

In view of this, the inventor of the present invention provides drawer type storage bins based on his professional experience of years in manufacturing and selling practising and after continuous study and improving, for eliminating disadvantage resided in the prior art and to result the expected functional design. Particularly, the characteristic of the drawer type storage bins reside in that, on the front face and above a handle of each bin, an outwardly bending transparent curved surface is porvided for magnifying images of the goods stored therein; a set of protruding buckles are provided on the rear side of each housing to fix every two stacked bins on this side by a locking strip having the length slightly longer than the height of each outer housing, so that many storage bins can be interengaged and fixed in this way in a stacking mode.

The main object of the present invention is to provide a drawer type storage bin, wherein, on the front face of the inner case thereof, an outwardly bending semi-transparent curved surface is porvided for magnifying images of the goods stored therein, so that the inner case can provide the clearest vision.

The secondary object of the present invention is to provide drawer type storage bins, wherein, the bins can be stacked one on another by interengagement of a plurality of locking strips and protruding buckcles, stability of the stacked bins can be increased and they are not easy to be separated and to fall.

Another object of the present invention is to provide drawer type storage bins, wherein, the looking strips can be attached to the outer housings of the bins during injection molding of the later and by means of material channels, and can be stripped off the outer housings when in use, this can save cost of production.

The present invention will be apparent in its practical structure, characteristics and functions after reading the detailed description of the preferred embodiment thereof in reference to the accompanying drawings.

DETAILED DESCRIPTION OF THE PREFERRED EMBODIMENT

Figure 1:
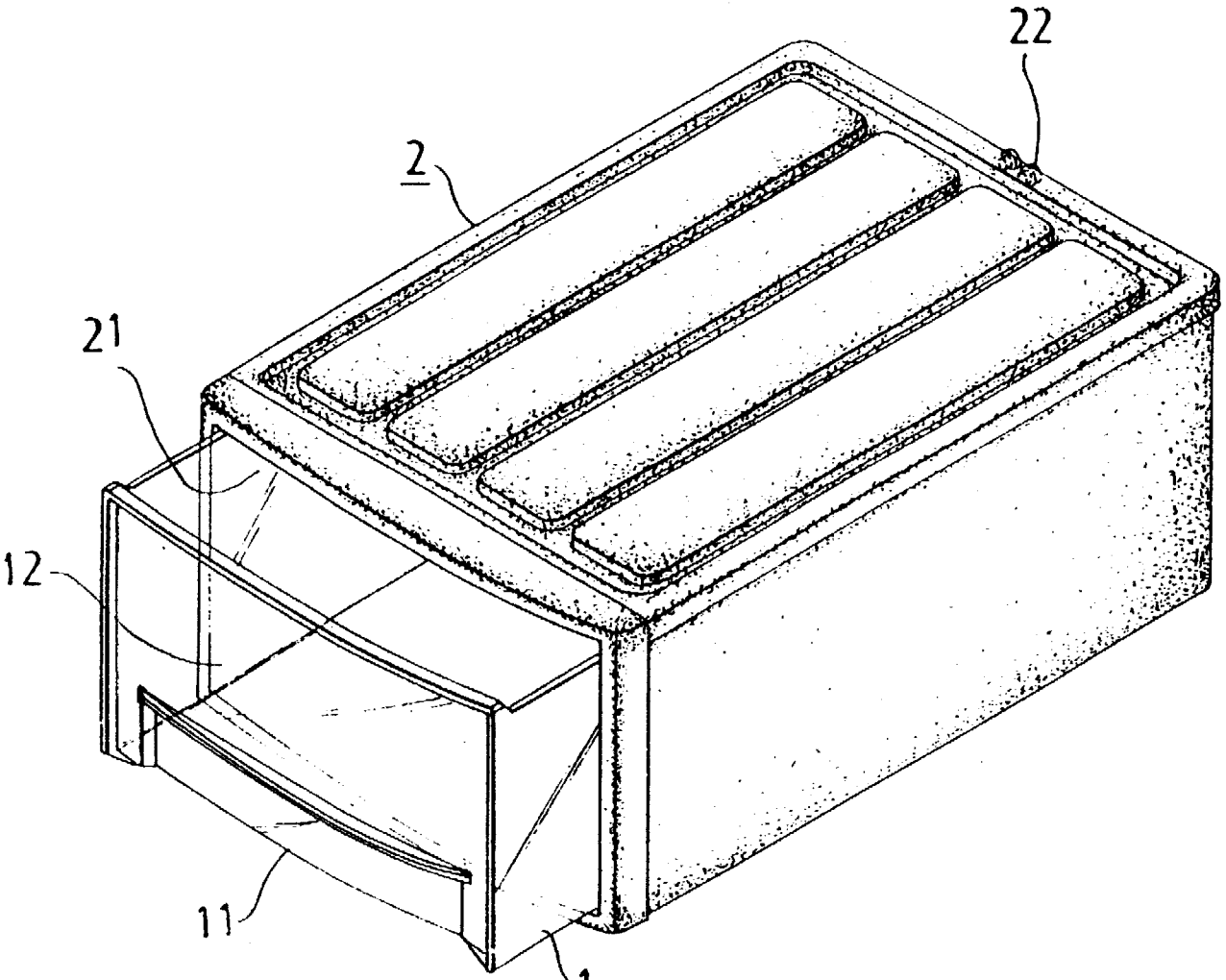
FIG. 1 is a perspective view of the present invention.
Figure 2:
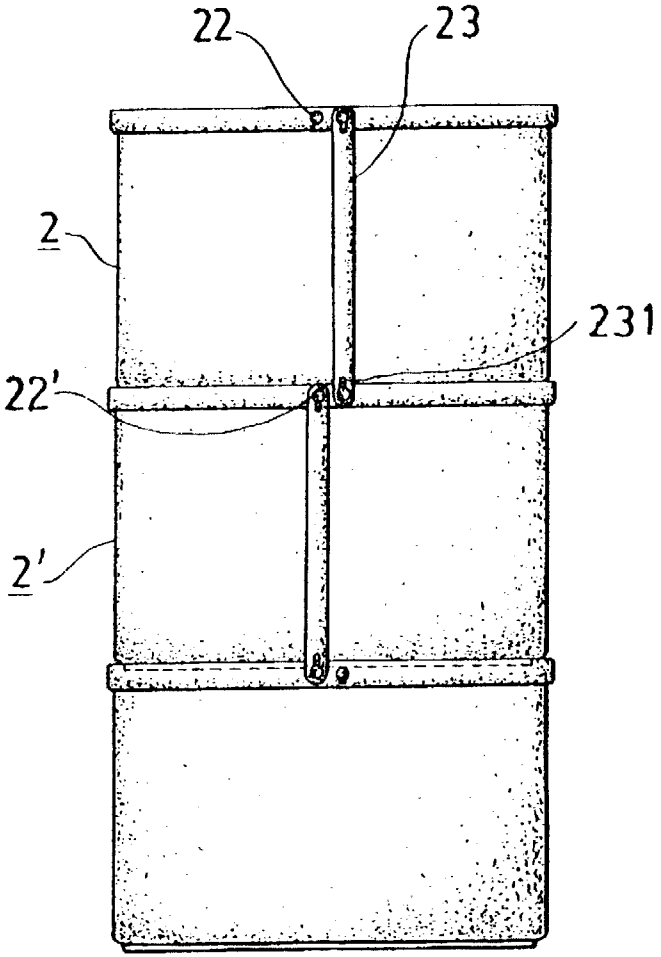
FIG. 2 is a rear side view of the present invention.
Figure 3:
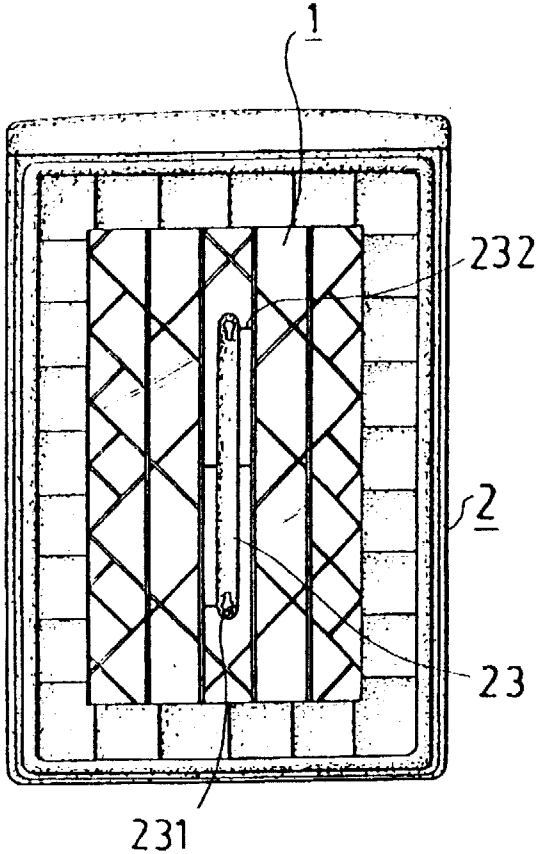
FIG. 3 is a bottom view of an outer housing of the present invention.

It can be clearly seen from FIG. 1 that, a drawer type storage bin of the present invention is comprised in its basic structure of an inner case 1 and an outer housing 2, wherein, the outer housing 2 is a rectangular body having an opening 21 on the front side thereof; the inner case 1 which is made of semi-transparent plastic material is fittedly received in the outer housing 2, the upper surface thereof is opened to form a trough like case, the front side thereof is provided with a handle 11; when the inner case 1 is placed in the outer housing 2, the handle 11 is exposed out of the opening 21 of the outer housing 2, the handle 11 can be pulled to be drawn out of the inner case 1, the trough like inner case 1 is for storing goods. The drawer type storage bin is characterized in that, on the front face 12 and above the handle 11 of the inner case 1 thereof, which front face 12 is at the opening 21 of the outer housing 2, a slightly outwardly bending semi-transparent curved surface is porvided for magnifying images of the goods stored therein to render them to be seen, so that the inner case can provide the clearest vision. The stored goods at the most inner portion of the inner case 1 can be seen clearly through the front face 12. Another characteristic of the present invention is resided in that, a set of protruding buckles 22 are provided on the top edge of the rear side of each outer housing 22 of each storage bin to fix the bins stacked one on another by interengagement of a plurality of locking strips 23 having locking holes 231 thereon capable of buckling the protruding buckles 22 (referring to FIG. 2). So that stability of the stacked bins can be increased, and they are not easy to be separated and to fall. The locking strips 23 each has a length slightly longer than the height of each outer housing 2, a locking hole 231 is provided on each end thereof, so that many storage bins can be interengaged and fixed in this way in a stacking mode. Another characteristic of the present invention is resided in that, the locking strip 23 needs no extraordinary molding in production, cost of production can thus be lowered. As is shown in FIG. 3, the bottom of the outer housing 2 is used only for holding the inner case 1 to prevent it from dropping, it can be formed as a net with meshes therein, the locking strip 23 can be formed in passing during injection molding of the outer housing 2 by means of a material channel 232 and therefore is attached on the meshed bottom surface of the outer housing 2, the material channel 232 can be broken off when in use, thereby the locking strip 23 can be stripped off the outer housing 2. This means that, there is no need to make the locking strip 23 outside the production process for the inner case 1 and the outer housing 2. In this way, cost of production can be largely reduced, yet the outer housing 2 can have a novel style of spacial structure.

In conclusion, the drawer type storage bin of the present invention has on the front face 12 of the inner case 1 thereof a slightly outwardly bending semi-transparent curved surface for magnifying images of the goods stored therein to render them to be seen. The protruding buckles 22 and the looking strip 23 on the outer housing 2 can increase stability of the drawer type storage bins stacked one on another; better result than the expected effect of the product can be achieved without increasing of cost of production; a novel style of structure of drawer type storage bins can be obtained and thus effect of the product is further increased.

Having thus described my invention, what I claim as new and desire to be secured by Letters Patent of the United States is:

1. A drawer type storage bin including:

an outer housing which is a rectangular body capable of stacking with another outer housing of another drawer type storage bin either on the top or the bottom thereof and having an opening on the front side thereof, a set of protruding buckles being provided on the top edge of the rear side of said outer housing;

an inner case with the upper surface thereof being opened to form a trough like case, said inner case being capable of being fittedly received in said outer housing, a handle provided on the front side thereof being exposed out of said opening of said outer housing, a slightly outwardly bending semi-transparent curved surface being porvided on said front side which is made of plastic;

a locking strip being integrately formed by means of a material channel with said outer housing and being attached on a meshed bottom surface of said outer housing, said material channel being able to be broken off when in use for stripping said locking strip off said outer housing, a locking hole being provided on each end of said locking strip and capable of buckling one of said protruding buckles;

by means of said inner case being porvided with said outwardly bending semi-transparent curved surface, images of the goods stored in said inner case can be magnified to render the goods to be seen, said locking strip buckling said protruding buckles on said and other outer housings on the top and the bottom of said outer housing with said locking holes to connect all said outer housings and achieving an effect of convenient use and firm and stable connection of a plurality of drawer type storage bins.

* * * * *